US005484008A

United States Patent [19]

Thompson

[11] Patent Number: 5,484,008

[45] Date of Patent: Jan. 16, 1996

[54] THERMOCOUPLE POSITIONER FOR DIRECTIONAL SOLIDIFICATION APPARATUS/PROCESS

[75] Inventor: Dennis J. Thompson, Holton, Mich.

[73] Assignee: Howmet Corporation, Greenwich, Conn.

[21] Appl. No.: 296,963

[22] Filed: Aug. 26, 1994

[51] Int. Cl.[6] ..... B22D 2/00; B22D 27/04

[52] U.S. Cl. ..... 164/338.1; 164/122.1; 164/151.4

[58] Field of Search ..... 164/122.1, 122.2, 164/151.4, 154.6, 338.1

[56] References Cited

U.S. PATENT DOCUMENTS 3,931,847 1/1976 Terkelsen ..... 164/122.1

4,175,609 11/1979 Elgammal et al. ..... 164/122.2

*Primary Examiner*—Kuang Y. Lin

*Attorney, Agent, or Firm*—Edward J. Timmer

[57] ABSTRACT

A thermocouple positioning device is provided for a directional solidification casting apparatus having a furnace for receiving a mold disposed on a chill plate that, in turn, is carried on a movable ram. The thermocouple positioning device comprises a support bracket disposed on the ram for movement therewith. The bracket includes an upstanding slide member and a slideway member disposed on the slide member and having a thermocouple holder thereon. A stop member is disposed in fixed position below the furnace for releasably engaging a stop engaging member on the slideway member as the ram is raised to position the mold in the furnace. Engagement between the stop member and the stop engaging member as the ram is raised positions the thermocouple in a temperature sensing position relative to the mold in the furnace. The thermocouple remains at the temperature sensing position as the mold is withdrawn from the furnace to effect directional solidification of the melt in the mold to form a columnar or single crystal casting in the mold.

10 Claims, 3 Drawing Sheets

THERMOCOUPLE POSITIONER FOR DIRECTIONAL SOLIDIFICATION APPARATUS/PROCESS

FIELD OF THE INVENTION

The present invention relates to a thermocouple positioning device for use in monitoring the position of a solidification front in directional solidification casting processes and apparatus.

BACKGROUND OF THE INVENTION

Directional solidification processes and apparatus are widely used in the metal casting art for producing a polycrystalline columnar microstructure or a single crystal microstructure in metal castings and resultant advantageous mechanical properties in certain directions of the casting. Directional solidification processes/apparatus are widely used in the aerospace industry to manufacture components, such as hot section blades and vanes for gas turbine engines, where the components must operate under conditions of high temperature and high stress.

U.S. Pat. No. 3,931,847 describes a directional solidification system of the withdrawal type wherein a melt filled, heated ceramic investment mold disposed on a chill plate is withdrawn from a heating chamber past a radiation (heat control) baffle to maintain a steep thermal gradient in the melt in the mold needed to achieve a solidification front that moves upwardly through the melt as the mold is withdrawn so as to form the desired unidirectionally solidified microstructure. The investment mold is provided with an auxiliary thermocouple-receiving post cavity for monitoring the temperature inside the mold during mold preheating prior to filling with melt. The thermocouple received in the post cavity is mounted on the chill plate so as to remain fixed in position in the post cavity for movement with the mold. A second thermocouple extends through an opening in the mold base for monitoring temperature outside the mold casting cavity in the heating chamber. The second thermocouple also is mounted on the chill plate for movement with the mold. A third thermocouple is mounted on the heating chamber cover so as not to move with the mold and functions as a temperature sensor for a heater process control. The arrangement of thermocouples described in the patent is provided to improve control of the mold temperature/chamber temperature during preheating and the solidification front in the melt during the directional solidification process.

U.S. Pat. No. 5,197,847 describes apparatus for manufacturing directionally solidified columnar or single crystal castings wherein mold withdrawal speed relative to a heating chamber is controlled during a casting trial of a particular cast component in response to melt temperature signals from thermocouples positioned in the melt in the mold. The mold withdrawal speed is controlled to maintain the solidification front at a more or less fixed location relative to a heat insulation (heat control) baffle. A computer process controller is programmed using the actual casting trial data (e.g. withdrawal speed profile data) to control mold withdrawal speed and other casting parameters during subsequent repeat casting cycles to produce like cast components without thermocouple contact with the melt.

U.S. Pat. No. 4,964,453 discloses directional solidification of superalloys by imposition of a predetermined temperature profile across the solidification front in the melt in the mold. The temperature profile across the solidification front is determined by thermocouples contacting the melt.

U.S. Pat. No. 4,281,985 describes a mechanical arrangement for automatically positioning thermocouples relative to a crucible in a vacuum furnace to monitor temperature of a charge melted in the crucible. A bellows is subjected to differential pressure so as to move between retracted and expanded positions for locating the thermocouples relative to the charge in the crucible.

SUMMARY OF THE INVENTION

The present invention involves casting apparatus having a furnace for receiving a mold disposed on a chill plate. The chill plate is carried on a movable ram such that the mold after being filled with melt can be withdrawn from the furnace to effect directional solidification of the melt to form a columnar or single crystal casting in the mold. The present invention provides a thermocouple positioning device comprising a support bracket disposed on the ram for movement therewith. The bracket includes an upstanding slide member and a slideway member disposed on the slide member for relative movement therebetween. The slideway member includes a thermocouple holder thereon. A stop member is disposed in fixed position below the furnace for engaging a stop engaging member on the slideway member as the ram is raised to position the mold in the furnace. When the stop member and stop engaging member are engaged, the thermocouple on the slideway member is positioned in a temperature sensing position relative to the mold in the furnace. The thermocouple remains at this temperature sensing position as the melt-filled mold is withdrawn by the ram from the furnace to effect directional solidification to form a columnar or single crystal casting in the mold. In particular, the thermocouple remains at the temperature sensing position by virtue of movement of the slide member relative to the stopped slideway member as the ram is lowered to withdraw the mold from the furnace. 10 In one embodiment of the invention, the support bracket comprises an upper support ring and lower support ring clamped on the ram and connected by an upstanding connector member. The connector member is substantially parallel to the slide member.

In another embodiment of the invention, the stop member comprises a detent plate and the stop engaging member comprises a spring biased plunger on the slideway member for releasably engaging the detent plate as the ram is raised to position the mold in the furnace.

In still another embodiment of the invention, the thermocouple includes an upstanding tubular body that is held by the thermocouple holder in a vertical orientation substantially parallel to the ram. The chill plate includes an aperture through which the thermocouple tubular body extends when positioned at the temperature sensing position.

In still a further embodiment of the invention, the casting mold includes an upstanding auxiliary cavity opening toward the chill plate, and the thermocouple is received in the auxiliary cavity through an aperture in the chill plate.

The present invention will be more fully described by way of example, with reference to the following drawings.

DESCRIPTION OF THE INVENTION

Figure 1:
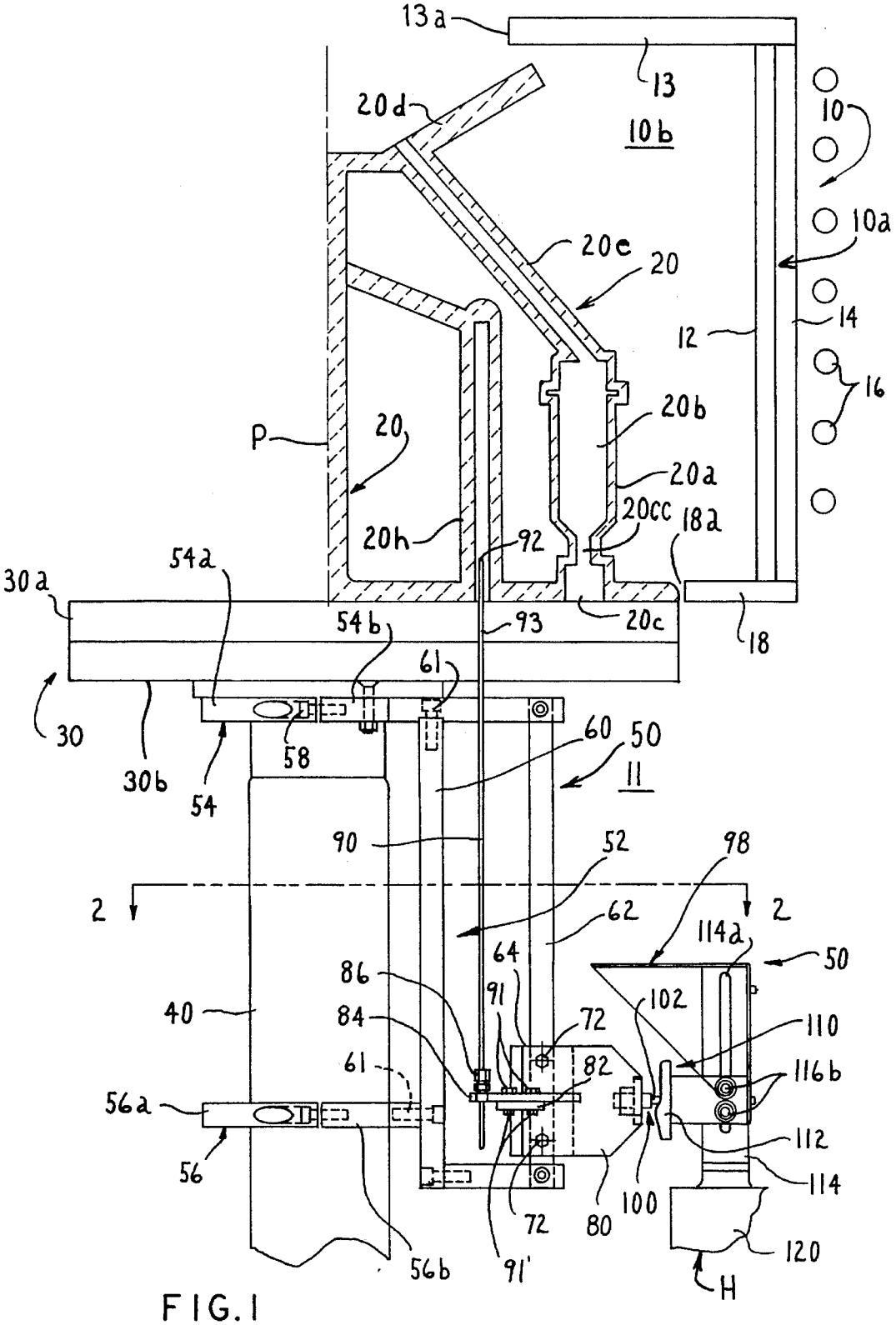
FIG. 1 is a side elevation of apparatus in accordance with one embodiment of the invention with the mold cluster (and casting furnace) only partially shown about its longitudinal axis for convenience.
Figure 2:
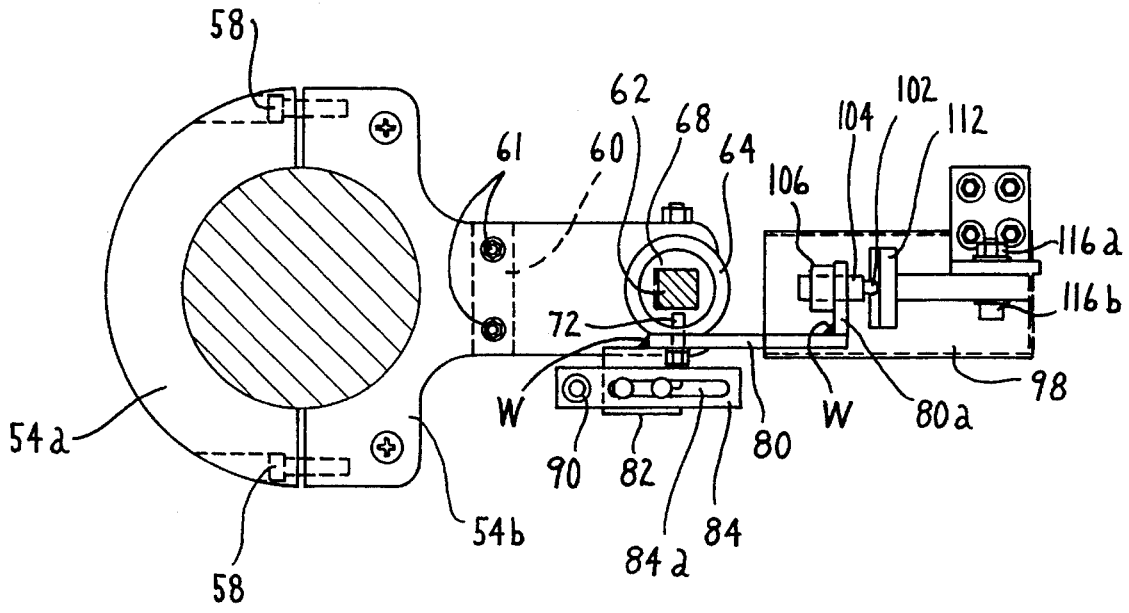
FIG. 2 is a view taken along lines 2—2 of FIG. 1.

FIGS. 1–2 illustrate directional solidification casting apparatus in accordance with one embodiment of the invention. Although the apparatus illustrated in FIGS. 1–2 is used in the manufacture of single crystal castings, the invention is not so limited and can be used as well to manufacture one or more polycrystalline columnar grain castings depending upon the type of mold or mold cluster used. Typically, a mold cluster comprising a plurality of article molds will be used in manufacture of plurality of castings. As is well known, in order to manufacture a plurality of single crystal castings using the apparatus of FIGS. 1–2, each mold of the mold cluster will include a crystal selector, such as a "pigtail" passage, between a grain initiator/growth cavity communicated to a chill plate and an article forming cavity thereabove effective to allow only one grain from among many grains growing upwardly from the chill plate in the lower grain initiator/growth cavity of each mold to further propagate through each mold as a single crystal casting.

The apparatus of FIG. 1–2 can be used to manufacture directionally solidified castings from nickel base and other superalloys commonly used in the manufacture of turbine blades and vanes, eutectic alloys, and other materials that in melt or melt-like (e.g. thixotropic) form can be solidified by unidirectional heat removal to form columnar, single crystal or other directional structure.

Referring to FIGS. 1–2, the illustrative directional solidification apparatus is shown comprising a heating or casting furnace 10 of usual type. In particular, the furnace 10 includes a tubular graphite or other susceptor 12 surrounded by insulation 14, such as graphite felt, that together form the sidewall 10*a* of the furnace. An induction coil 16 is disposed about the susceptor 12 in usual manner to heat the susceptor and thus the chamber 10*b* within the furnace. The top of the furnace chamber 10*b* is closed off by an annular cover plate 13 having a central opening 13*a* through which melt can be introduced into the casting mold cluster 20 (partially shown for convenience) positioned in the chamber 10*b* from a crucible (not shown) in an upper melting chamber. The opening is closed by a suitable movable cover (not shown) when the mold cluster is being preheated prior to casting of the melt therein.

The bottom of the furnace chamber 10*b* is partially closed off in usual manner by an annular heat control baffle 18 made of graphite material. The baffle 18 includes a central opening 18*a* through which the mold cluster 20 is withdrawn from the furnace chamber 10*b* into the cooling chamber 11 disposed below the furnace chamber 10*b* after the mold is filled with melt. The furnace chamber 10*b* and the cooling chamber 11 typically are disposed within a conventional vacuum housing (not shown) having water cooled walls if the melt is to be solidified under relative vacuum (subambient pressure) conditions. Unidirectional solidification of the melt in the individual molds 20*a* (one shown) of the mold cluster 20 is effected by heat removal from the melt via the chill plate 30 on which the mold cluster is disposed and opens via the open mold bottom shown and by radiation of heat from the melt-filled mold cluster to the cooled walls of the aforementioned vacuum chamber as the mold is withdrawn below the heat control baffle 18.

The mold cluster 20 is disposed on a conventional water cooled chill plate 30 fastened to the top of a vertically movable ram 40 so that the melt filled mold 20 can be withdrawn from the furnace chamber 10*b* into a cooling chamber 11 as described hereabove.

The illustrated investment mold cluster 20 is made by the well known lost wax process in which a plurality of wax or other fugitive patterns having the shape of the articles to be cast are joined with wax or other fugitive sprues, pour cup, and other conventional mold components to form a cluster assembly that is repeatedly dipped in ceramic slurry, stuccoed with dry ceramic stucco and dried to build up a ceramic shell on the cluster assembly. The cluster assembly then is removed from the ceramic shell by heating, dissolution or other means so as to leave the ceramic shell mold cluster that is fired to improve mold strength for casting. The ceramic mold cluster 20 typically includes a plurality of article forming molds 20*a* (one shown) disposed in spaced apart circumferential relation about a central post P of the mold cluster. Each mold 20*a* includes an article forming cavity 20*b* having a grain initiator/growth cavity 20*c* therebelow and open to the chill plate 30 so that the melt therein contacts the chill plate. A crystal selector passage 20*cc*, such as a well-known "pigtail" (shown schematically), is disposed between each article forming cavity 20*b* and grain initiator/growth cavity 20*c* to select a single grain for propagation through cavity 20*b*. In this manner, heat is removed from the melt unidirectionally via the chill plate to initiate and grow columnar grains in the cavity 20*c* one of which is selected for propagation through the article forming cavity 20*b* thereabove. The article forming cavities are supplied with melt from pour cup 20*d* by respective supply sprues 20*e* of the mold cluster.

In practicing an embodiment of the invention, the mold cluster 20 includes an upstanding thermocouple-receiving hollow post 20*h* that is open to the chill plate 30. This hollow post is formed by including in the pattern assembly a suitable wax or other fugitive rod extending vertically upward prior to investing the assembly with ceramic. The hollow post 20*h* is located proximate to an individual article forming mold 20*a* of the mold cluster such that the temperature in the hollow post simulates to an extent the temperature of melt in the article forming cavity 20*b* as the melt-filled mold cluster is withdrawn from the furnace chamber 10*b* by the ram 40. The thermocouple sensed temperature in the hollow post 20*h* provides temperature data that can be used to control withdrawal speed of the melt-filled mold cluster 20 from the chamber 10*b*.

The investment mold cluster 20 shown is particularly adapted for producing single crystal castings. The Piearcey U.S. Pat. No. 3,494,709 describes a mold for single crystal casting. The invention can be practiced to produce polycrystalline columnar grain castings as described in the VerSynder U.S. Pat. No. 3,260,505. Eutectic alloys also can be directionally solidified in the practice of the invention. U.S. Pat. No. 3,793,010 describes directional solidification of eutectics.

The investment mold cluster 20 is moved vertically up and down relative to the furnace chamber 10*b* and baffle 18 via the ram 40 which is raised/lowered by a conventional hydraulic, electrical or other actuator (not shown). As is well known, the mold cluster 20 initially is positioned in the furnace chamber 10*b* for preheating to a suitable casting temperature. After the mold preheating step, the melt is introduced into the mold cluster in the furnace chamber 10*b* typically from a crucible (not shown) located above the furnace chamber 10*b* in a separate melting chamber of the vacuum housing. After the mold cluster 20 is filled with melt, the mold cluster can be withdrawn from the furnace chamber 10*b* past heat control baffle 18 to effect directional solidification of the melt therein to form a single crystal casting therein.

In accordance with one embodiment of the invention, a thermocouple positioning device 50 is carried on the cylindrical ram 40 for upward movement therewith as the mold cluster 20 is positioned in the chamber 10*b*. The thermocouple positioning device 50 comprises a support bracket 52 having an upper annular support ring 54 and lower annular support ring 56 clamped on and about the ram 40. The rings 54, 56 each comprises a pair of clamp sections 54*a*, 54*b*; 56*a*, 56*b* that are connected together via machine screws 58 in order to clamp the rings about the ram 40 as shown in FIGS. 1–2.

The clamp rings 54, 56 are connected by an upstanding connector member 60 by machine screws 61 shown. The connector member 60 is disposed substantially parallel to an upstanding slide member 62 fastened between the clamp rings 54, 56 outboard of the connector member 60 in the manner shown. The clamp rings 54, 56; connector member 60, and slide member 62 are movable with the ram 40 in both the up and down directions during the casting cycle of the mold cluster.

The bracket 52 also includes a slideway member 64 disposed on the slide member 62 for relative sliding movement therebetween. The slideway member 64 includes anti-friction bushing or bearing 68 received in the slideway and held therein by set screws or bolts 72. As shown best in FIG. 2, the bushing or bearing 68 includes a square cross-section to receive the square cross-section of the slide member 62 such that the slide member and slideway member are slidable relative to one another.

The slideway member 64 includes an upstanding support plate 80 welded thereto at welds W. The plate 80 includes a horizontally oriented stub plate 82 welded thereto and extending toward the ram 40. Disposed for movement on the stub plate 82 is a horizontally oriented thermocouple support plate 84 having a compression fitting (thermocouple holder) 86 at one end to receive and hold a thermocouple tubular body 90 in a vertical orientation as shown in FIG. 1. The holding plate 84 includes a slot 84*a* that receives a pair of locking screws 91 that extend through a similar aligned slot in the stub plate 82 and are engaged by nuts 91' on the underside thereof. The holding plate 84 can be adjusted in the horizontal position relative to ram 40 by loosing screws 91, sliding the holding plate 84 an appropriate distance relative on the stub late 82, and tightening the nuts 91'. Adjustment of the thermocouple position is thereby achievable.

The thermocouple tubular body 90 receives a thermocouple bead 92 and a pair of lead wires (not shown) that extend from the bead 92 through the tubular body 90 to an input of a casting process controller (not shown) to provide temperature signals to the controller. The tubular body 90, thermocouple bead 92 and lead wires comprise a conventional thermocouple assembly.

As shown in FIG. 1, in the illustrated embodiment of the invention, the thermocouple tubular body 90 extends through an upstanding passage or aperture 93 in the chill plate 30 a distance above the upper surface of the chill plate to enter into the hollow post 20*h*.

At the other end of the support plate 80 is a stop engaging member 100 illustrated as a spring biased plunger 102. The plunger body 104 is attached to the extension 80*a* of the plate 80 by a threaded nut 106 engaging a threaded section of the plunger body 104 as shown best in FIG. 2.

The spring biased plunger 102 is positioned on the plate extension 80*a* so as to engage a stop member 110 illustrated as detent plate 112 mounted on a post 114 on the bottom or floor 120 of the vacuum housing H. The post 114 includes a slot 114*a* through which a pair of attachment and adjustment nuts 116*a*/bolts 116*b* of the detent plate 110 extend. The vertical position of the detent plate 110 is adjustable by loosening the nuts/bolts, adjusting the detent plate up or down on the post 114, and tightening the nuts/bolts. The detent plate 112 is thereby disposed in fixed position below the furnace chamber 10*b* for engaging the spring plunger 102 carried on the slideway member 64 as the ram 40 is raised to position the mold cluster 20 in the furnace chamber 10*b*.

A shield 98 may be mounted on the post 114 to overlie the plunger 102 and detent plate 110 and shield them from molten metal and/or heat.

Figure 3:
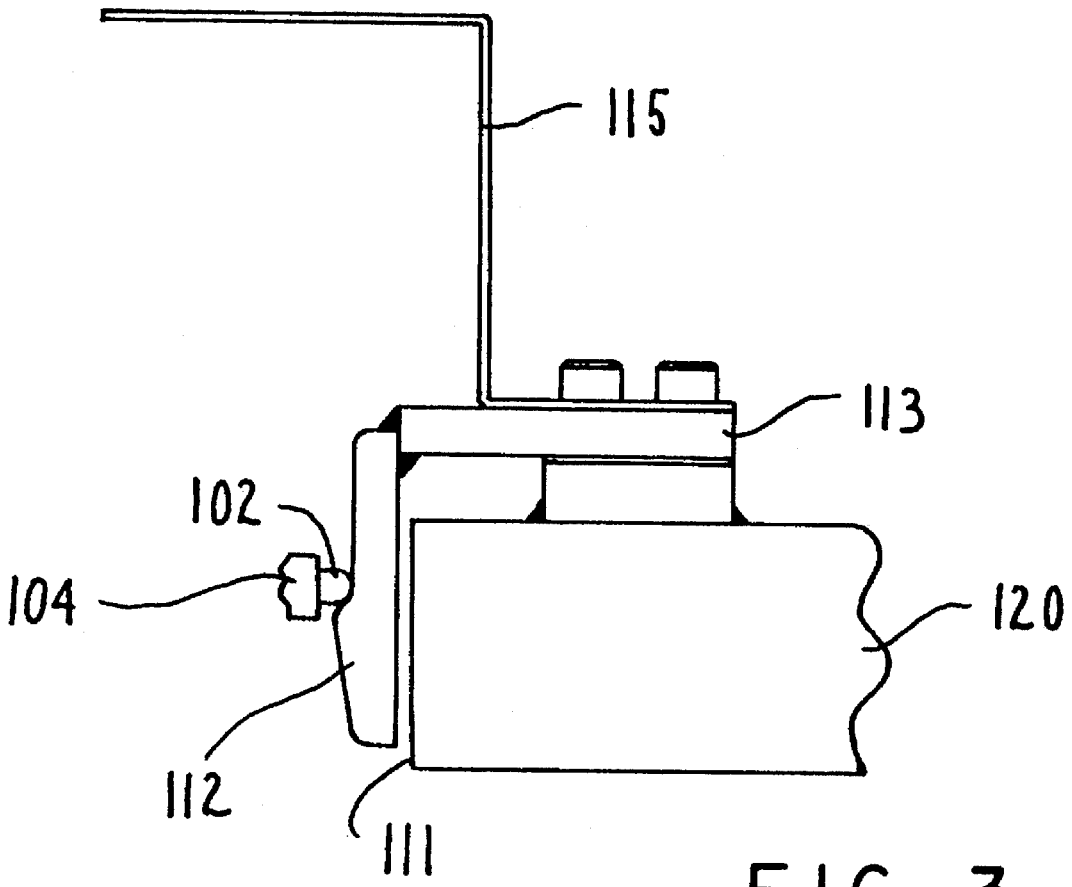
FIG. 3 is a partial elevation of an alternative stop member for use in practicing the invention.

Referring to FIG. 3 wherein like features are represented by like reference numerals, the detent plate 112 can be located in a different position from that shown in FIG. 1. In particular, the detent plate 112 can be located within an opening 111 in the floor of the vacuum housing in the event a reduced clearance susceptor 12 is present. For example, the detent plate 112 can be mounted from a horizontal plate 113 itself mounted on the floor of the vacuum housing as shown. A shield 115 can be employed for the same purpose as shield 98 described above.

When the plunger 102 (stop engaging member) and detent plate 112 (stop member) are engaged as shown, for example, in FIG. 1, the bead 92 of the thermocouple assembly carried on the slideway member 64 is positioned in a temperature sensing position relative to the mold 20. The thermocouple remains at this temperature sensing position as the melt-filled mold cluster 20 is withdrawn by the ram 40 from the furnace chamber 10*b* to effect directional solidification of the melt in the mold cluster to form columnar or single crystal castings in the article forming molds 20*a* thereof. In particular, as the melt-filled mold cluster 20 is withdrawn from the chamber 10*b* by lowering of the ram 40, the slideway member 64 carrying the thermocouple assembly is held in fixed position by engagement of the spring biased plunger 102 and detent plate 112 while the slide member 62 slides through the bushing or bearing 68 of the slideway member 64 with downward movement of the ram 40.

The thermocouple assembly therefore remains in fixed position in the chamber 10*b* as the melt-filled mold cluster 20 is withdrawn therefrom so that the bead 92 can sense the change in temperature in the post 20*h*, which post temperature simulates to an extent the change in the temperature of the melt in the article forming cavities 20*c* as the mold cluster is withdrawn from the chamber 10*b*.

After the melt-filled mold cluster 20 is withdrawn to its lowermost position in the cooling chamber 11 where the melt therein has been directionally solidified as a single crystal, columnar grain, or eutectic structure, the melt-filled mold cluster is lowered on the ram 40 through an underlying airtight interlock into a mold removal chamber (not shown) where the melt-filled mold cluster is removed from the chill plate 30 and replaced with a fresh mold for casting.

At the lowermost mold position in the vacuum housing (i.e. prior to transfer of the mold cluster through the interlock), the slideway member 64 will be located proximate the upper end of the slide member 62 as a result of the movement of the slide member with the ram 40 while the slideway member remains fixed in location by engagement of the plunger 102 and the detent plate 112. At this lowermost mold position in the vacuum housing, the slideway member 64 is returned to a location proximate the lower end of the slide member 62 by manually disengaging it from the detent plate 112 and sliding it downwardly to the desired lower position on the slide member 62. When the fresh mold is positioned in the furnace chamber 10*b* by raising of the ram 40, the slideway member 64 will again engage the detent plate 112 via the spring biased plunger 102 thereon to properly position the thermocouple assembly relative to the fresh mold 20 in the furnace chamber 10*b*.

Although the invention has been shown and described with respect to certain embodiments thereof, it should be understood by those skilled in the art that other various changes and omissions in the form and detail thereof may be therein without departing from the spirit and the scope of the invention.

The embodiments of the invention in which an exclusive property or privilege is claimed are defined as follows:

1. A casting apparatus comprising a mold and chill plate, said apparatus further comprising a furnace for receiving the mold disposed on the chill plate that is carried on a movable ram such that after being filled with melt, the mold can be withdrawn from the furnace to effect directional solidification of said melt, and having a thermocouple positioning device comprising:

a support bracket disposed on the ram for movement therewith, said bracket having an upstanding slide member and a slideway member disposed on said slide member for relative movement therebetween, said slideway member having a thermocouple holder thereon, a stop member disposed in fixed position below the furnace, said slideway member having a stop engaging member for engaging said stop member as the ram is raised to position the mold in the furnace, and a thermocouple disposed on said slideway member for positioning in a temperature sensing position relative to said mold in said furnace by engagement between said stop member and said stop engaging member, said thermocouple remaining at said temperature sensing position by virtue of movement of said slide member relative to said slideway member as the mold is withdrawn from the furnace to effect directional solidification of said melt in said mold.

2. Apparatus of claim 1 wherein said bracket comprises an upper support ring and lower support ring clamped on the ram and connected by an upstanding connector member.

3. Apparatus of claim 2 wherein said connector member is substantially parallel to said slide member.

4. Apparatus of claim 1 wherein said stop member comprises a detent plate.

5. Apparatus of claim 4 wherein said stop engaging member comprises a spring biased plunger engageable with said detent plate as the ram is raised to position the mold in the furnace.

6. Apparatus of claim 1 wherein said thermocouple includes an upstanding tubular body.

7. Apparatus of claim 6 wherein said thermocouple tubular body is held by a thermocouple holder on said slideway member in a vertical orientation substantially parallel to said ram.

8. Apparatus of claim 7 wherein the chill plate includes an upstanding aperture through which the thermocouple body extends when the thermocouple is positioned at said temperature sensing position.

9. Apparatus of claim 1 wherein said mold includes an auxiliary cavity opening toward said chill plate and said thermocouple is received in said auxiliary cavity.

10. Apparatus of claim 1 wherein said slideway member includes an anti-friction bushing for receiving said slide member.

* * * * *